United States Patent [19]

Broman et al.

[11] 4,070,276

[45] Jan. 24, 1978

[54] FLOTATION PROCESS OF LEAD-, COPPER-, URANIUM- AND RARE EARTH MINERALS

[75] Inventors: Per Gunnar Broman, Sala; Per Gudmar Kihlstedt; Carl Du Rietz, both of Bromma, all of Sweden

[73] Assignee: Berol Kemi AB, Stenungsund, Sweden

[21] Appl. No.: 647,676

[22] Filed: Jan. 9, 1976

[30] Foreign Application Priority Data

Jan. 15, 1975 Sweden ..... 7500421

[51] Int. Cl.[2] ..... B03D 1/02

[52] U.S. Cl. ..... 209/166

[58] Field of Search ..... 209/166, 167; 260/534 E

[56] References Cited

U.S. PATENT DOCUMENTS

| | | | |
|---|---|---|---|
| 1,952,907 | 3/1934 | Christmann | 209/166 |
| 2,103,872 | 12/1937 | Schoeller | 209/166 X |
| 2,267,307 | 12/1941 | Ralston | 209/166 |
| 2,287,274 | 6/1942 | Ralston | 209/167 |
| 2,407,203 | 9/1946 | Cole | 209/166 X |
| 2,414,199 | 1/1947 | Gutzeit | 209/166 |
| 2,647,629 | 8/1953 | Veltman | 209/166 |
| 3,430,641 | 3/1969 | Newman | 260/534 E X |
| 3,725,473 | 4/1973 | Sundby | 260/534 E |
| 3,834,533 | 9/1974 | McGuire | 209/166 |

FOREIGN PATENT DOCUMENTS

| | | | |
|---|---|---|---|
| 934,046 | 10/1955 | Germany | 260/534 E |
| 2,258,535 | 6/1973 | Germany | 260/534 E |

OTHER PUBLICATIONS

Chem. Abst., 83, 1975, p. 200, 31263f.

*Primary Examiner*—Robert Halper

[57] ABSTRACT

A process and flotation agents are provided for flotation of lead-, uranium-, and rare earth-type minerals and ores in which an aqueous pulp of the mineral or ore is subjected to a froth flotation, characterized in that the flotation is performed in the presence of a tertiary amine flotation agent having the general formula:

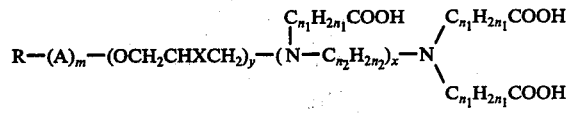

wherein:

R is a aliphatic hydrocarbon group having from about six to about twenty four carbon atoms;

A is an oxyalkylene group having from about two to about four carbon atoms;

X is selected from the group consisting of hydrogen and hydroxyl;

$m$ is a number within the range from 0 to about 10;

$n_1$ is a number within the range from 1 to about 4;

$n_2$ is 1, 2 or 3;

$x$ is a number within the range from 0 to about 4;

$y$ is 0 or 1;

the sum of $m + y$ being within the range from 1 to about 11; and salts thereof.

The process is especially applicable in the flotation of sulphide and oxide ores and minerals.

6 Claims, No Drawings

FLOTATION PROCESS OF LEAD-, COPPER-, URANIUM- AND RARE EARTH MINERALS

As flotation agents for the flotation of sulphide ores and minerals such as those containing lead sulphide and zinc sulphide, mainly compounds containing divalent sulphur are used, such as alkyl xanthate,

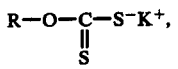

or dialkyldithiophosphate,

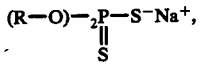

where R represents an alkyl group. The disadvantage with this kind of flotation agent is that undesirable minerals, such as pyrite, in certain cases, are also separated together with the desired minerals, lead sulphide and zinc sulphide. Furthermore, flotation agents containing divalent sulphur are sensitive to oxidation. For the separation of complex sulphide ores, it would be particularly desirable to develop flotation agents with more specific chemisorptive properties than the customary ones.

For the separation of oxide ores and minerals, mainly unsaturated fatty acids are used, such as oleic acid and linolenic acid, in certain cases in combination with paraffin hydrocarbons. Chemisorption of the fatty acid on the mineral or ore is an inverse function of the solubility product for the cations on the surface of the mineral or ore, and the anion of the fatty acid used. However, the differences in the solubility product of the salts of fatty acid anion and the most important divalent cations are rather insignificant, and therefore in a fatty acid flotation a particular selectivity cannot be expected. The use of amphoteric compounds has been proposed, i.e., of the kind that are described in French Pat. No. 2,197,657, but these flotation agents also have poor selectivity, and small differences in the solubility product between salts of different cations. There is therefore a need for more specific flotation agents in the flotation of oxide ores and minerals.

According to the invention it has now been discovered that tertiary amine flotation agents can be used for the flotation of lead-, copper-, uranium-, and rare earth-type minerals of sulphide and oxide ores and minerals. The process according to the invention enriches sulphide and oxide ores and minerals as to lead-, copper-, uranium-, and rare earth-type ores and minerals by froth flotation of an aqueous pulp of the ore or mineral in the presence of a tertiary amine flotation agent having the general formula:

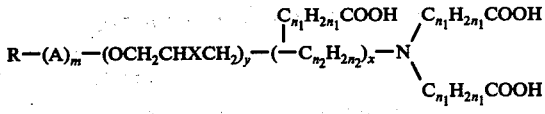

wherein:

R is a aliphatic hydrocarbon group having from about six to about twenty four carbon atoms;

A is an oxyalkylene group having from about two to about four carbon atoms;

X is selected from the group consisting of hydrogen and hydroxyl;

$m$ is a number within the range from 0 to about 10;

$n_1$ is a number within the range from 1 to about 4;

$n_2$ is 1, 2 or 3;

$x$ is a number within the range from 0 to about 4;

$y$ is 0 or 1;

the sum of $m + y$ being within the range from 1 to about 11; and salts thereof.

As R, any ethylenically unsaturated or saturated aliphatic hydrocarbon group can be used. Illustrative R groups include hexyl, isohexyl, heptyl, isoheptyl, octyl, 2-ethyl hexyl, isooctyl, nonyl, decyl, undecyl, dodecyl, tridecyl, tetradecyl, hexadecyl, octadecyl, eicosyl, behenyl, melissyl, stearyl linoleyl, linolenyl and ricinoleyl.

Exemplary A alkylene groups include oxyethylene, oxy-1,3-propylene, oxy-1,2-propylene, oxy-1,4-butylene, oxy-1,3-butylene, oxy-1,2-butylene, and oxy-2,3-butylene.

It will be understood that $m$, $x$ and $y$ need not be integers, but will usually be average numbers, representing the average of the several species that may be present.

Exemplary flotation agents of the invention include:

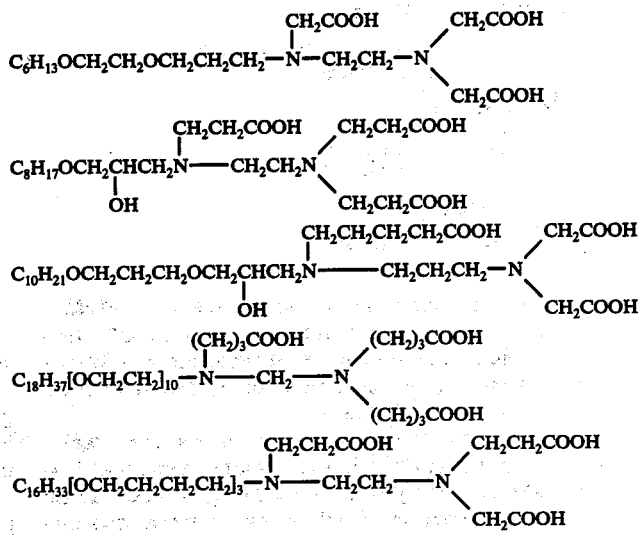

-continued

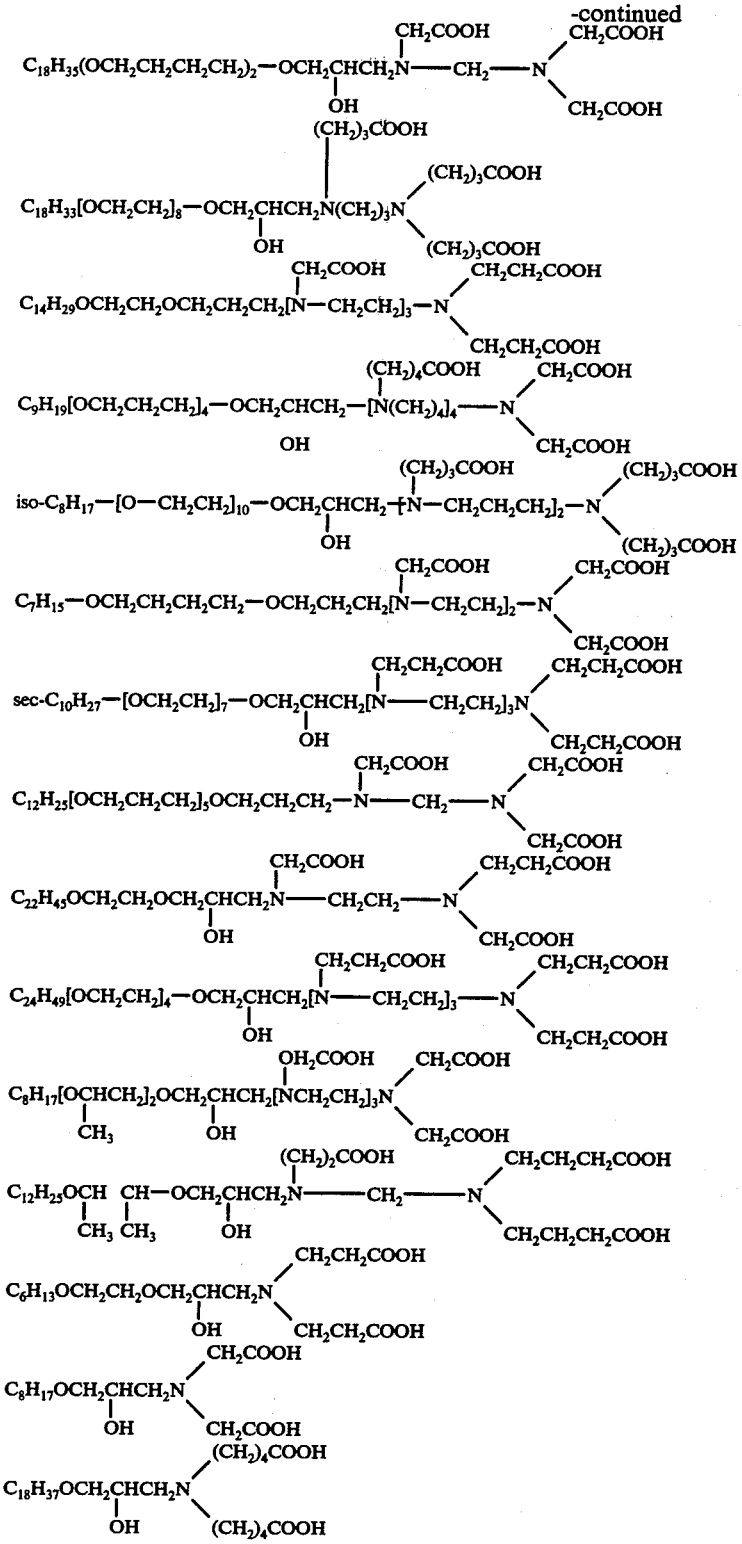

These compounds can be used in the form of their inorganic or organic acid salts, such as sodium, potassium, lithium, ammonium, triethanolamine, tributylamine, monoethanolamine, butylamine, dimethylamine, morpholine or pyridine salts.

The flotation agents of the invention are usually added in an amount of within the range from about 5 to about 500, preferably from 10 to 200, grams per metric ton of ore. The reason why the instant compounds show such specific chemisorptive properties is not known, but it is suggested that the two carboxylic acid end groups on the terminal amino nitrogen atoms probably form insoluble salts or complexes with the cations in the mineral or ore surface. By varying R, A and *m* in a suitable manner, and if so desired, incorporating the group $(OCH_2CHXCH)_2$, X having the meaning mentioned above, it is easy to avoid precipitation in the presence of multivalent cations, i.e., calcium ions, in the pulp at the same time as the chemisorptive properties of the flotation agent may be adapted to the specific conditions of the mineral or ore.

The tertiary amine compound containing an A substituent can for example be obtained by condensing onto a suitable organic hydroxyl compound substrate, in known manner, ethylene oxide and/or propylene oxide and/or butylene oxide, in an amount within the range from about 0.5 to about 10 moles alkylene oxide per mole hydroxyl compound. The organic hydroxyl compound (if no A group is present) or the alkylene oxide adduct thereof (if an A group is present) is reacted with an alkyl nitrile, after which the product is hydrogenated to form the amine compound. If an $OCH_2CHXCH_2$ group is present, the hydroxyl compound or the alkylene oxide adduct can be reacted with epichlorohydrin, thus obtaining a chloroglyceryl ether, that can easily be converted to the desired tertiary amine compound by the reaction with an iminodicarboxylic acid. An amine compound is obtained that can easily be converted into the desired tertiary amine compound by reaction with halogen carboxylic acids having the general formula Hal $C_{n_1}H_{2n}COOH$, Hal representing a halogen, and $n$ having the meaning mentioned before, or by reaction with formaldehyde and sodium cyanide, according to the Strecker process.

In flotation using the present process pH-regulators may be added, as well as depressants and activators, in known manner. In most flotation processes the pH-value is of importance in obtaining a good separation. The flotation agents according to the invention give improved possibilities for the separation or fractionation of different types of minerals and ores according to the selection of a suitable pH. In the same way, and if considered convenient, it is possible to add conventional activators and depressants. It is not possible to be more specific since each mineral or ore finally has to be treated in accordance with its own chemical and physical composition.

The process in accordance with the invention is further illustrated by the following Example:

EXAMPLE

A lead sulphide-containing ore from Laisvall, Sweden, containing about 4% Pb and with quartz as the major gangue mineral, was crushed so that 80% passed through a 74μm mesh sieve. The crushed ore was froth flotated as an aqueous slurry at a pH of from 8.25 to 8.50 using 50 grams per ton of ore of a flotation agent having the formula:

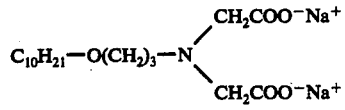

The flotated mineral had a Pb content of about 62%, and represented a total yield of about 89%. This Example shows that the flotation agent according to the invention has very good flotation properties.

Having regard to the foregoing disclosure, the following is claimed as inventive and patentable embodiments thereof:

1. A process for the flotation of oxides and sulfides of lead copper, uranium, and rare earth minerals and ores, which comprises subjecting an aqueous pulp of the mineral or ore to a froth flotation to float said minerals and ores from a gangue in the presence of a tertiary amine flotation agent having the general formula:

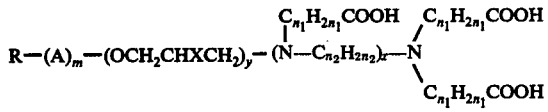

wherein:

R is an aliphatic hydrocarbon group having from about six to about twentyfour carbon atoms;

A is an oxyalkylene group having from about two to about four carbon atoms;

$x$ is selected from the group consisting of hydrogen and hydroxyl;

$m$ is a number within the range from 0 to about 10;

$n_1$ is a number within the range from 1 to about 4;

$n_2$ is 1, 2 or 3;

$x$ is a number within the range from about 0 to about 4; and $y$ is 0 or 1;

the sum of $m + y$ being within the range from 1 to about 11; and salts thereof.

2. A process in accordance with claim 1, in which the ore is a lead sulfide-containing ore.

3. A process in accordance with claim 1, in which the tertiary amine flotation agent is a compound wherein A is oxypropylene, $m$ is 1, $x$ and $y$ are 0, and $n_1$ is 1.

4. A process in accordance with claim 1 in which the tertiary amine flotation agent is a compound in which $m$ is a number within the range from 0 to 4, $x$ is 0, $y$ is 0 or 1, and $n_1$ is 1 or 2.

5. A process in accordance with claim 1, in which the tertiary amine flotation agent is a compound in which the sum of $m + y$ is within the range from 1 to 3.

6. A process in accordance with claim 1, in which the tertiary amine flotation agent is a salt of an inorganic or organic acid.

* * * * *

UNITED STATES PATENT OFFICE

CERTIFICATE OF CORRECTION

Patent No. 4,070,276 Dated January 24, 1978

Inventor(s) Per Gunnar Broman et al

It is certified that error appears in the above-identified patent and that said Letters Patent are hereby corrected as shown below:

[54] The Title should read -- Process For Flotation Of Lead-, Copper-, Uranium-, And Rare Earth-Type Minerals And Ores And Flotation Agents Therefor --.

Column 2, line 11 :

"

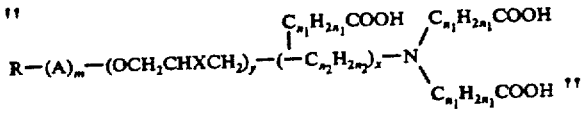

should be

--

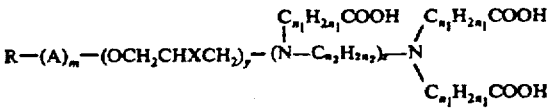

-- line 18 : "a" should be --an--

UNITED STATES PATENT OFFICE

CERTIFICATE OF CORRECTION

Patent No. 4,070,276 Dated January 24, 1978

Inventor(s) Per Gunnar Broman et al

It is certified that error appears in the above-identified patent and that said Letters Patent are hereby corrected as shown below:

Column 3, fourth formula: "

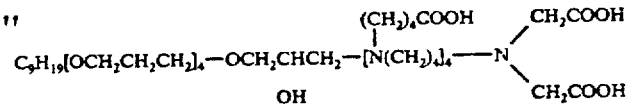

"

should be

-- 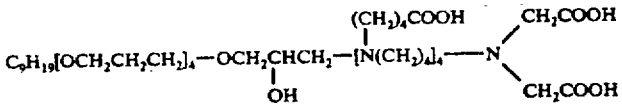 --

Column 3, eleventh formula: "

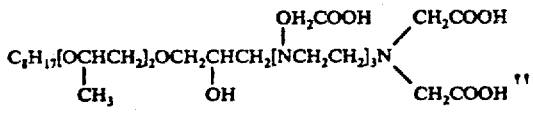

"

should be

-- 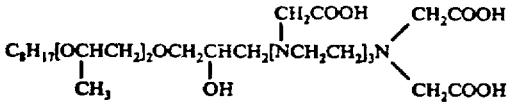 --

Column 6, line 29 : "twentyfour" should be -- twenty-four--

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*